US010071300B2

(12) United States Patent
Herberth

(10) Patent No.: US 10,071,300 B2
(45) Date of Patent: Sep. 11, 2018

(54) GOLF TRAINING AID

(71) Applicant: Erik Mark Herberth, Cornelius, NC (US)

(72) Inventor: Erik Mark Herberth, Cornelius, NC (US)

( * ) Notice: Subject to any disclaimer, the term of this patent is extended or adjusted under 35 U.S.C. 154(b) by 0 days.

(21) Appl. No.: 15/662,780

(22) Filed: Jul. 28, 2017

(65) Prior Publication Data

US 2018/0028893 A1 Feb. 1, 2018

Related U.S. Application Data

(60) Provisional application No. 62/367,685, filed on Jul. 28, 2016.

(51) Int. Cl.
*A63B 69/36* (2006.01)

(52) U.S. Cl.
CPC ..... *A63B 69/3608* (2013.01); *A63B 69/3676* (2013.01)

(58) Field of Classification Search
USPC ..... 473/212–214, 226, 227, 229, 266, 276
See application file for complete search history.

(56) References Cited

U.S. PATENT DOCUMENTS 5,174,575 A * 12/1992 Leith ..... A63B 69/0059 473/213
6,471,598 B2 * 10/2002 Takase ..... A63B 69/0059 473/207
6,827,654 B2 * 12/2004 Meyer ..... A63B 69/0059 24/300
7,455,595 B1 * 11/2008 Gibbons ..... A63B 69/3608 473/212
7,547,256 B1 * 6/2009 Petrie ..... A63B 69/0059 473/207

* cited by examiner

*Primary Examiner* — Nini Legesse
(74) *Attorney, Agent, or Firm* — Dunlap Bennett & Ludwig PLLC

(57) ABSTRACT

A golf training aid is provided. The golf training aid includes a brace. The brace has a looped strap configured to wrap around and attach to an arm of a user. An elongated rod includes a top end and a bottom end. A first connector rod includes a first end and a second end. The first end is coupled to and extends laterally from the top end of the elongated rod and the second end is coupled to the brace. A second connector rod includes a first end and a second end. The first end is coupled to and extending laterally from the bottom end of the elongated rod. A clamp is coupled to the second end of the second connector rod and is configured to secure to a shaft of a golf club.

9 Claims, 4 Drawing Sheets

GOLF TRAINING AID

CROSS-REFERENCE TO RELATED APPLICATION

This application claims the benefit of priority of U.S. provisional application Ser. No. 62/367,685, filed Jul. 28, 2016, the contents of which are herein incorporated by reference.

BACKGROUND OF THE INVENTION

The present invention relates to golf and, more particularly, to a golf training aid.

The short game in golf is one of the most difficult aspects of the game to master. Maintaining the radius of the golf swing in the set-up position is difficult to achieve for most golfers.

As can be seen, there is a need for a golf training aid that helps a golfer have a more consistent short game.

SUMMARY OF THE INVENTION

In one aspect of the present invention, a golf training aid comprises: a brace comprising a looped strap configured to wrap around and attach to an arm of a user; an elongated rod comprising a top end and a bottom end, wherein the top end is attached to the brace; and a clamp attached to the bottom end of the elongated rod and configured to secure to a shaft of a gold club.

These and other features, aspects and advantages of the present invention will become better understood with reference to the following drawings, description and claims.

DETAILED DESCRIPTION OF THE INVENTION

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

The present invention includes a lightweight device that attaches to the shaft of a golf club and to the players trailing arm creating two fixed points. The device fixes to the shaft of the golf club just below the grip and fixes to the players forearm near the elbow. By creating two fixed points between the golf club and the player, the player is prevented from making the mistake and therefore creating a repeatable movement to reinforce good habits to create long lasting muscle memory. The present invention may also be fully adjustable allowing any size player to use it effectively.

Figure 1:
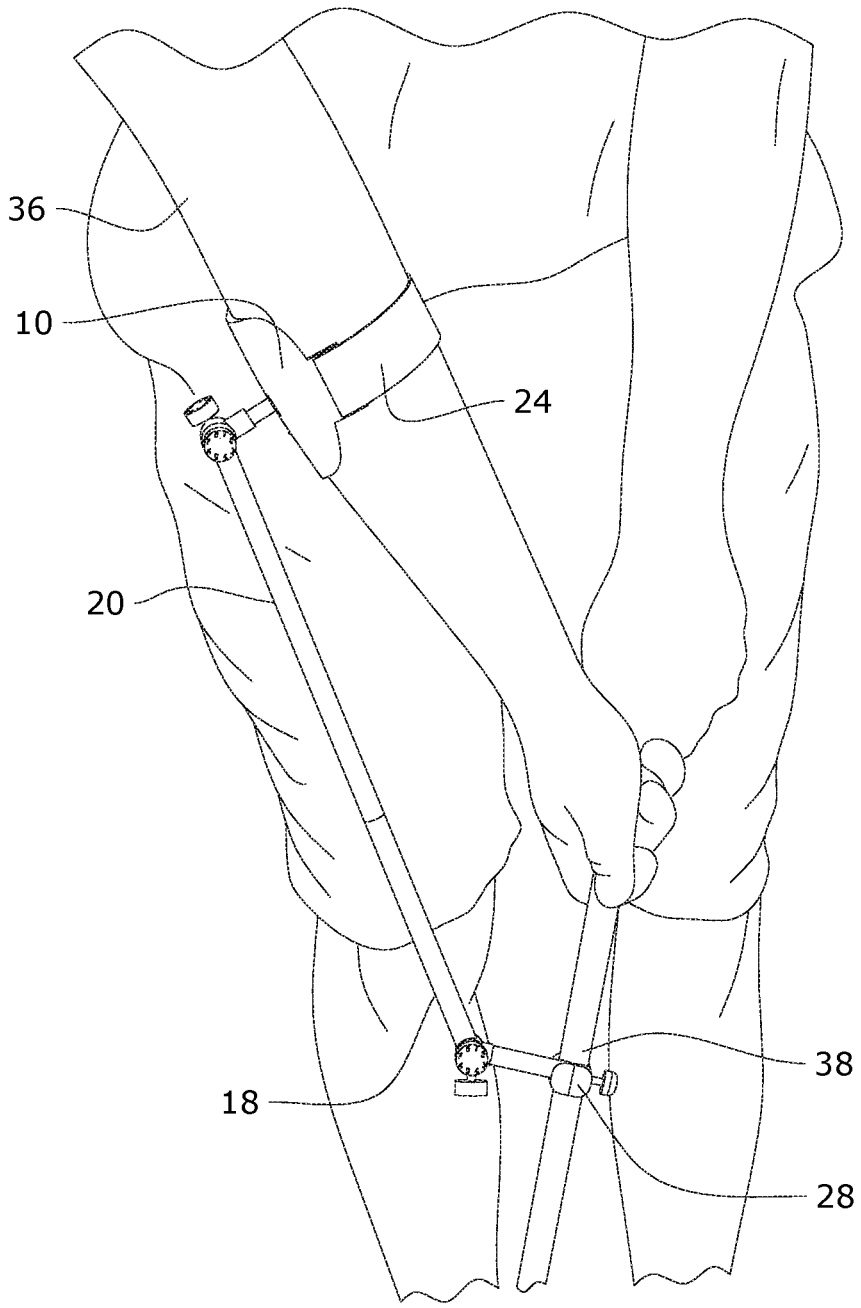
FIG. 1 is a perspective view of an embodiment of the present invention shown in use.
Figure 2:
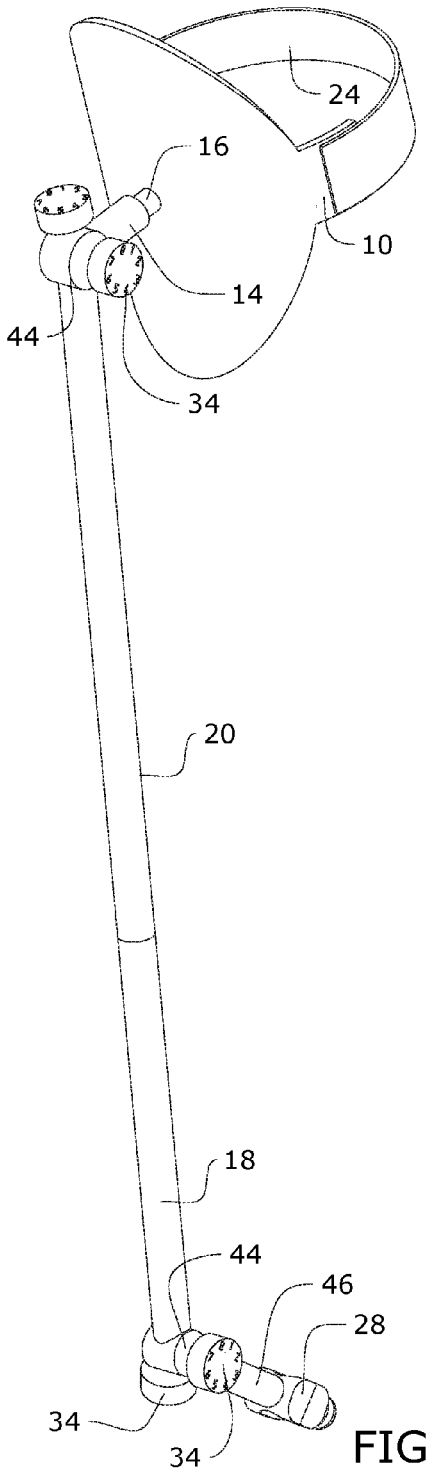
FIG. 2 is a perspective view of an embodiment of the present invention.
Figure 3:
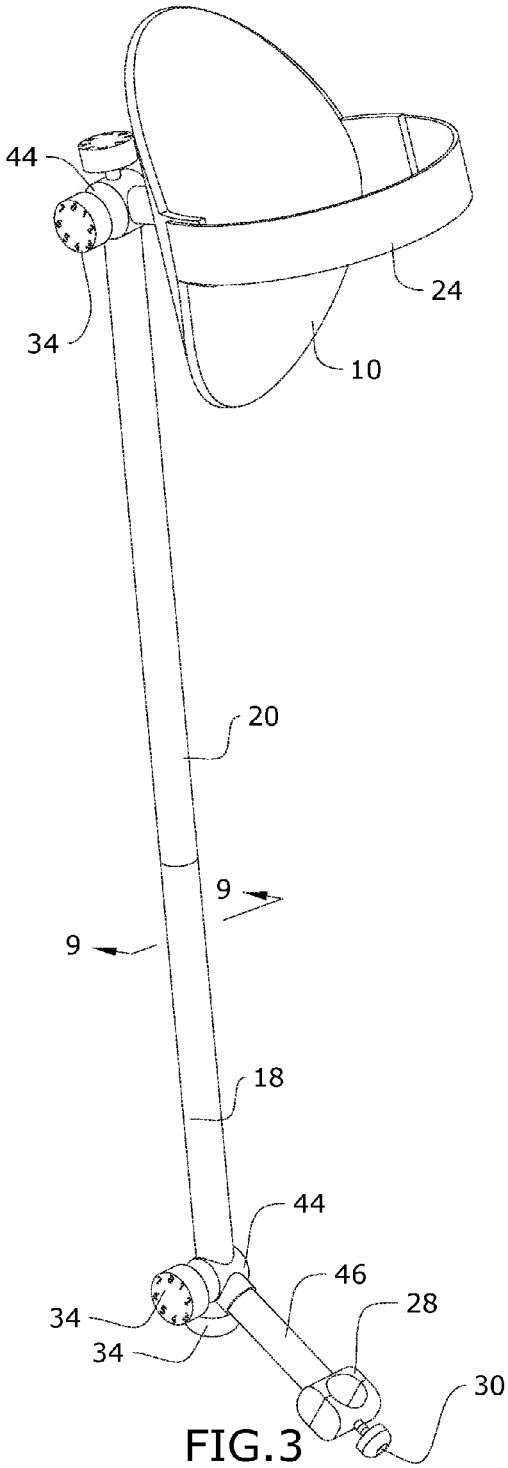
FIG. 3 is a perspective view of an embodiment of the present invention
Figure 4:
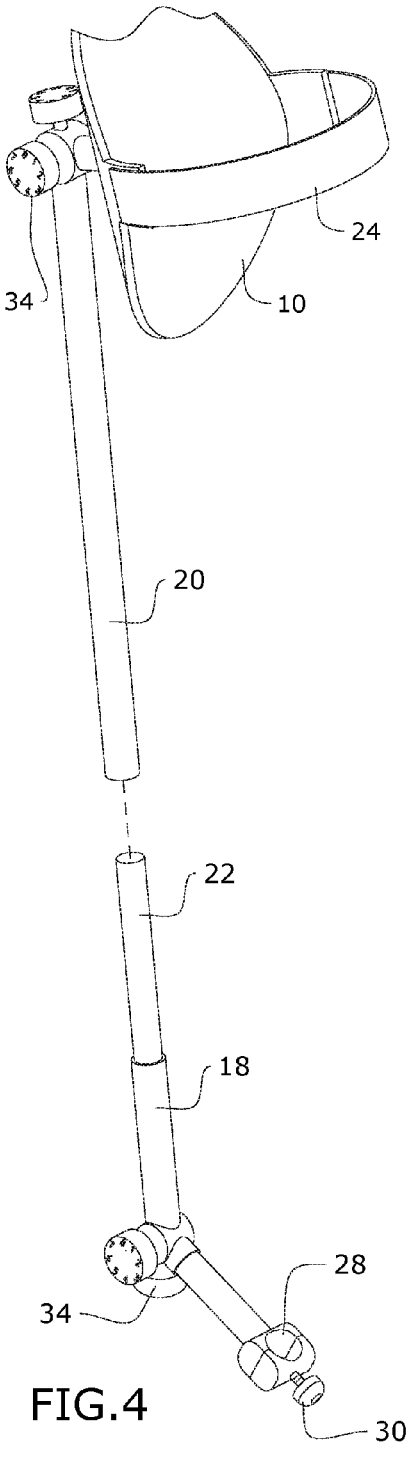
FIG. 4 is an exploded view of an embodiment of the present invention.
Figure 5:
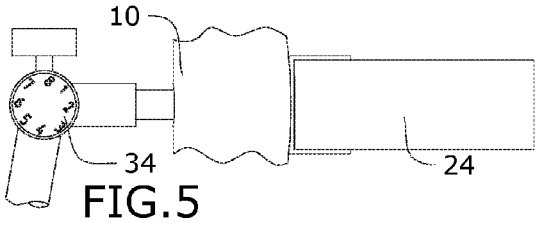
FIG. 5 is a detail side view of an embodiment of the present invention in an exemplary initial configuration.
Figure 6:
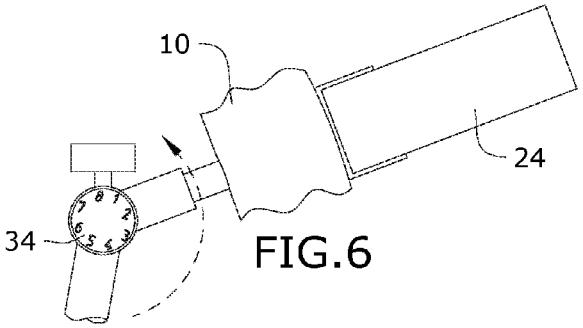
FIG. 6 is a detail side view of an embodiment of the present invention in an exemplary secondary configuration.
Figure 7:
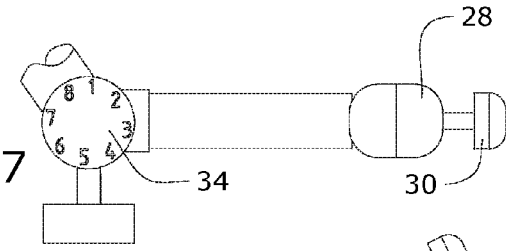
FIG. 7 is a detail side view of an embodiment of the present invention in an exemplary initial configuration.
Figure 8:
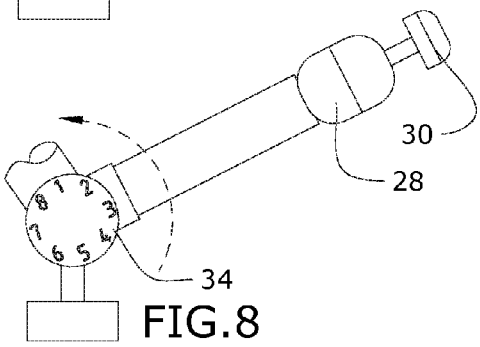
FIG. 8 is a detail side view of an embodiment of the present invention in an exemplary secondary configuration.
Figure 9:
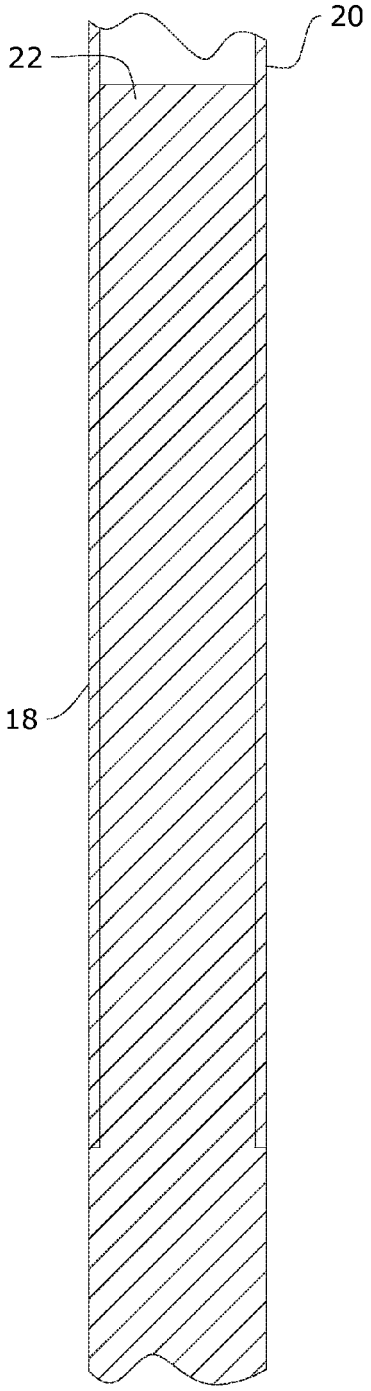
FIG. 9 is a section detail view taken along line 9-9 in FIG. 3.
Figure 10:
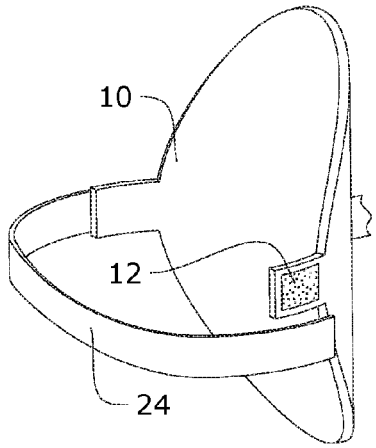
FIG. 10 is a perspective detail view of an embodiment of the present invention.
Figure 11:
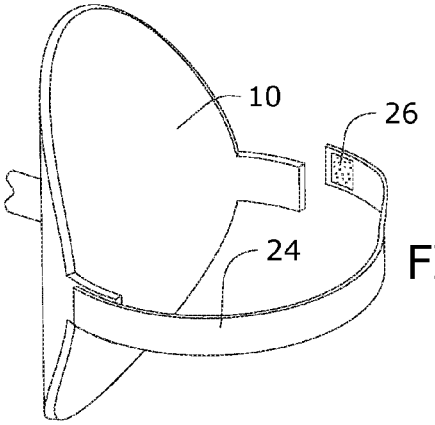
FIG. 11 is a perspective detail view of an embodiment of the present invention.

Referring to FIGS. 1 through 13, the present invention includes a golf training aid. The golf training aid includes a brace 10. The brace 10 has a looped strap 24 configured to wrap around and attach to an arm 36 of a user. An elongated rod 20 includes a top end and a bottom end. A first connector rod 14 includes a first end and a second end. The first end is coupled to and extends laterally from the top end of the elongated rod 20 and the second end is coupled to the brace 10. A second connector rod 46 includes a first end and a second end. The first end is coupled to and extending laterally from the bottom end of the elongated rod 20. A clamp 28 is coupled to the second end of the second connector rod 46 and is configured to secure to a shaft of a golf club 38.

The brace 10 of the present invention may secure to a user's forearm near the elbow. The brace 10 may further include an elbow padding. In such embodiments, the strap 24 includes a first end and a second end. The elbow padding may include a first tab extending from a first side and a second tab extending from a second side. The first end of the strap 24 may be fixedly attached to the first tab. The second end of the strap 24 may include a connector 26 that releasably attaches to a connector 12 of the second tab. The connectors may include clips, snaps, hook and loop fasteners, magnets, and the like. To attach the brace 20, the user may wrap the strap 24 around their arm and attach the connectors 12, 26 together.

The elongated rod 20 of the present invention may be extendable in length to fit the many different sizes of golfers. Further, the elongated rod 20 may include telescoping tubes. For example, the elongated rod 20 may further include a lower rod 18 and an inner rod 22 that slides into the elongated rod 20. The first connector rod 14 may also be extendable in length. Further, the first connector rod 14 may include telescoping tubes. For example, an inner tube 16 may slide into the first connector rod 14. The inner tube 16 may be coupled to the elbow padding.

The elongated rod 20 may be vertically disposed. The first connector rod 14 and the second connector rod 46 may be horizontally disposed and protrude from the elongated rod 20 in substantially the same direction.

The present invention may further include an upper pivoting joint 44 pivotally coupling the first connector rod 14 to the top end of the elongated rod 20. The upper pivoting joint 44 allows the first connector rod 14 to pivot relative to the elongated rod 20 along a first axis and a second axis. Knobs 34 are operable to tighten the upper pivoting joint 44 to a fixed position and loosen the upper pivoting joint 44 to a pivoting position. The present invention may further include a lower pivoting joint 44 pivotally coupling the second connector rod 46 to the bottom end of the elongated rod 20. The lower pivoting joint 44 allows the first connector rod 14 to pivot relative to the elongated rod 20 along a first axis and a second axis. Knobs 34 are operable to tighten the lower pivoting joint 44 to a fixed position and loosen the lower pivoting joint 44 to a pivoting position. The angle of the first and second connector rods 14, 46 are adjustable to be used for different strokes.

Alternatively, rotating the knobs 34 may directly rotate the pivoting joints 44. In such embodiments, the present invention may include incremental numbering circumferentially printed on each of the knobs 34. For the upper pivoting joint 44, each of the numbers represent a different angle of the brace 10 relative to the elongated rod 20. In such embodiments, the present invention may include an upper knob 34 that rotates about a vertical axis and a side knob 34 that rotates about a horizontal axis. The upper knob 34 may be rotated to move the brace 10 from side to side and the side knob 34 may be rotated to move the brace 10 up and down. For the lower pivoting joint 44 each of the numbers represent a different angle of the second connector rod 46 relative to the elongated rod 20. In such embodiments, the present invention may include a lower knob 34 that rotates about a vertical axis and a side knob 34 that rotates about a horizontal axis. The lower knob 34 may be rotated to move the clamp 28 from side to side and the side knob 34 may be rotated to move the clamp 28 up and down. Each position snaps into place when the knobs 34 are rotated so that the connector rods 14, 46 are at a fixed angle relative to the elongated rod 20.

In certain embodiments, the clamp 28 includes a first clamp member and a second clamp member. The first clamp member and the second clamp member each include U-shaped cutouts on the inner surface sized to surround the shaft of the golf club 38. A rotatable screw knob 30 fits through openings formed through the first and second clamp members. The rotatable screw knob 30 is operable to clamp the first clamp member and the second clamp member together and to the golf club shaft 38 when rotated.

The rod between the shaft and the forearm creates two fixed points. This insures that the golfers maintain the same amount of space between the shaft and forearm throughout the motion. By doing so, the golfer is creating a constant radius for the arc of the golf club leading to more consistent strikes. The brace may include a foam pad layer that rests against the players forearm and is secured in place by the strap. This allows the golfer to practice a repetitive movement training his/her body and mind in the correct way. By adjusting some of the angles, it can be used for almost all aspects of the short game including, chipping, pitching, and putter. The set up for each of these shots is slightly different and by allowing the player to adjust a couple of angles, the present invention can be used for many different shots.

It should be understood, of course, that the foregoing relates to exemplary embodiments of the invention and that modifications may be made without departing from the spirit and scope of the invention as set forth in the following claims.

What is claimed is:

1. A golf training aid comprising:

a brace comprising a looped strap configured to wrap around and attach to an arm of a user;

an elongated rod comprising a top end and a bottom end, wherein the top end is attached to the brace;

a clamp attached to the bottom end of the elongated rod and configured to secure to a shaft of a gold club; and an upper pivoting joint pivotally coupling the top end of the elongated rod to the brace and operable to move the brace side to side and up and down relative to the elongated rod.

2. The golf training aid of claim 1, wherein the brace further comprises an elbow padding attached to opposing ends of the looped strap.

3. The golf training aid of claim 1, further comprising a lower pivoting joint pivotally coupling the clamp to the bottom end of the elongated rod.

4. The golf training aid of claim 3, wherein the lower pivoting joint is operable to move the clamp side to side and up and down relative to the elongated rod.

5. The golf training aid of claim 1, wherein the elongated rod is adjustable in length and comprises telescoping tubes.

6. The golf training aid of claim 1, further comprising a first connector rod comprising a first end and a second end, wherein the first end is coupled to and extending laterally from the top end of the elongated rod and the second end is coupled to the brace, and a second connector rod comprising a first end and a second end, wherein the first end is coupled to and extending laterally from the bottom end of the elongated rod.

7. The golf training aid of claim 6, wherein the first connector rod is adjustable in length and comprises telescoping tubes.

8. The golf training aid of claim 1, wherein the clamp comprises a first clamp member and a second clamp member each comprising U-shaped cutouts sized to fit around a golf club shaft.

9. A golf training aid comprising:

a brace comprising a looped strap configured to wrap around and attach to an arm of a user;

an elongated rod comprising a top end and a bottom end, wherein the top end is attached to the brace;

a clamp attached to the bottom end of the elongated rod and configured to secure to a shaft of a gold club; and a lower pivoting joint pivotally coupling the bottom end of the elongated rod to the clamp and operable to move the clamp side to side and up and down relative to the elongated rod.

* * * * *